US006244476B1

(12) United States Patent
Moretti

(10) Patent No.: US 6,244,476 B1
(45) Date of Patent: Jun. 12, 2001

(54) DISPENSER CAP FOR FLUID SUBSTANCE CONTAINERS

(75) Inventor: Matteo Moretti, Crema (IT)

(73) Assignee: Lumson S.p.A., Capergnanica (IT)

( * ) Notice: Subject to any disclaimer, the term of this patent is extended or adjusted under 35 U.S.C. 154(b) by 0 days.

(21) Appl. No.: 09/476,087

(22) Filed: Jan. 3, 2000

(30) Foreign Application Priority Data

Mar. 8, 1999 (IT) ..... MI99A0468
May 31, 1999 (IT) ..... MI99A1212

(51) Int. Cl.[7] ..... B67D 3/00
(52) U.S. Cl. ..... 222/521; 222/520
(58) Field of Search ..... 222/520, 521

(56) References Cited

U.S. PATENT DOCUMENTS 3,010,619 * 10/1961 Gronemeyer ..... 222/521
3,240,404 3/1966 Porter et al. .
3,834,596 * 9/1974 Brady et al. ..... 222/520
4,561,570 * 12/1985 Zulauf et al. ..... 222/521
4,690,304 * 9/1987 Morel ..... 222/520
5,004,127 4/1991 Morel .
5,421,487 6/1995 Moretti .

FOREIGN PATENT DOCUMENTS 0 270 134 6/1988 (EP) .
1 113 774 1/1962 (FR) .

* cited by examiner

*Primary Examiner*—Joseph A. Kaufman
*Assistant Examiner*—Frederick C Nicolas
(74) *Attorney, Agent, or Firm*—Oblon, Spivak, McClelland, Maier & Neustadt, P.C.

(57) ABSTRACT

A fluid substance dispenser cap, formed in only two component parts, for fitting onto the neck of containers having an external thread, the two parts being shaped in such a manner as to prevent accidental separation of the cap from the neck of the container on which it is mounted.

2 Claims, 2 Drawing Sheets

DISPENSER CAP FOR FLUID SUBSTANCE CONTAINERS

BACKGROUND OF THE INVENTION

1. Field of the Invention

The present invention generally relates to a dispenser cap and more particularly, to a dispenser cap which is applicable to the mouth of a fluid substance container and operable, by simple rotation to close the container mouth and to open the container mouth to enable the substance to be dispensed.

2. Discussion of Background

Various types of cap are known to be applicable to a container mouth to close or open the passage through the mouth by simply rotating the outermost component forming part of each cap.

U.S. Pat. Nos. 5,004,127 and 5,421,487 (corresponding to EP-B-0598223) describe caps formed from three separate, but mutually cooperating parts. A first part is securely fixed on the container mouth. A second part is rotatable about the first. A third component part is rotatably constrained to the second part, but relative to which the second part, can freely slide axially. The third component part is connected to the first part by a screw coupling or similar in such a manner as to slide axially to the first part when the second part is rotated about the first part.

As will be apparent, the structure of such caps is very complicated and their cost is high. One reason for the high cost is the difficulty of constructing the coupling systems between their constituent parts with the necessary precision.

Caps of simpler structure, formed in only two parts, are described in U.S. Pat. No. 4,690,304. The two pieces are secured together by a cam or screw system such that rotating the first piece causes the second piece to slide relative to it, with consequent opening or closure of the discharge hole in the cap. The structure of this cap is complex and costly and requires the container mouth to be especially shaped to fix and retain one of the two pieces forming the cap.

EP-A-0270134 also describes a cap formed in two pieces, wherein one is screwed onto the other. The inner piece is superposed on and screwed onto a thread provided on the outside of the container neck. The cap structure is complex because a screw coupling system has to be provided between the two constituent pieces of the cap.

The caps described in the above described patents all have a serious drawback deriving from the fact that the two or three constituent parts of the caps are positioned on the outside of the mouth or neck of the container on which they are mounted.

The caps are fairly large in size (in terms of their cross-section), which means that if the container neck is of normal size (ie., having a relatively large cross-section), the cap has necessarily to have an even greater cross-section, which is unacceptable.

This means that to keep the cap cross-section within acceptably small values, the only usable and practical solution (which is that followed in practice) is to considerably reduce the cross-section of the container mouth or neck to much less than the usual transverse dimensions of the mouth or neck of a normal container of equal capacity. This has a further serious consequence, namely that the hole through which the fluid substance (liquid or cream) is fed into the container by automatic machines is small. Hence the container filling operation is slowed, requiring the filling machine to be adjusted differently depending on whether the mouth is to be closed by a normal one-piece closure cap or whether a dispenser cap of known type is to be used on it.

Dispenser caps formed in only two pieces are already described in U.S. Pat. Nos. 3,010,619, 3,240,404 and FR-A-1113774. One of the two pieces is a hollow profiled body. One portion of the hollow profiled body is inserted and retained in the hole of a container neck. A second of the two pieces is a head, superposed on the hollow profiled body and lying above the free end of the container neck. On the outer surface of the neck of the container, a thread with which a thread provided inside the head engages.

The head can be rotated on the threaded container neck to traverse, relative thereto, from a lowered position, in which a discharge hole, provided at the top of the head, is pressed and sealed against the end of an appendix projecting from the body, and a position in which the head discharge hole is raised from the appendix to free the discharge hole, through which the substance contained in the container, on which the cap is mounted, can flow out.

The caps described in the three above-described patents have the serious drawback that their constituent head can be freely unscrewed and removed from the container neck, to leave the body still fitted to the neck, so that the substance contained in the container can be accidentally spilled.

The above-described problem is partially solved by the cap described in FR-A-1370761. This cap is also in two parts such as those described in the three above-described patents, but comprises opposing annular ribs projecting from the profiled body and head. The annular ribs projecting from the profiled body and the head mutually interfere with each other, when the head is unscrewed from the container neck (ie., to free the discharge hole provided in it) thus, hindering or preventing separation of the head from the body. However, there is again a serious drawback, in that if the head is rotated in the unscrewing direction to a greater degree than is necessary to completely open the discharge hole, the annular rib on the head engages the annular rib on the body and drags it axially to extract the body from the hole in the container neck. This occurs because the head can exert a strong dragging action on the body in the axial direction, even though the force necessary to rotate the head around the neck thread is small. The result is that the entire dispenser cap can easily separate from the container neck, and the substance in the container be poured out without any control.

SUMMARY OF THE INVENTION

An object of the present is therefore to provide a low-cost dispenser cap of simple construction formed from only two component parts, and which can be easily fitted to containers having the size of mouth closable by a normal closure and hence without having to modify generally used containers in any way.

A further fundamental object is to provide a cap of the above-described type which cannot be accidentally removed (wholly or partly) from the neck of the container on which it is fitted.

These and further objects are attained by a dispenser cap comprising: a head bounded by a lateral wall and a top wall at the center of which there is provided a discharge hole about which there extends, internal to the lateral wall of the head, a cylindrical tubular wall projecting from the top wall; a profiled body housed in the interior of the head and having a first tubular wall adjacent to and movable relative to the tubular wall of the head; an elongate appendix forming part of the body and extending inside the first tubular wall, with the free end of the appendix superposable on the head discharge hole to seal it; a second tubular wall extending from the body in the opposite direction to that in which the first tubular wall extends; at least one aperture provided in the body to directly connect together the spaces bounded by the two tubular walls projecting from it; the outer diameter of the second tubular wall being substantially complementary to the inner diameter of the hole in the neck of a container on which the cap is to be mounted with the second tubular wall inserted and retained in the container neck; the profiled body having an outward shoulder the diameter of which is greater than that of the hole in the container neck; the head being superposable on the free end of the container neck and having on the inner surface of its lateral part at least one helical thread or groove engageable with a corresponding helical groove or thread or similar provided on the outer surface of the container neck to enable the head to be screwed or unscrewed on the container neck between a position in which the head discharge hole is sealed by the free end of the appendix on the body and a position in which the hole is free and distant from the appendix; from the opposing surfaces of the tubular wall of the head and of the first tubular wall of the body there projecting, in proximity to their respective free ends, annular ribs which seal against the surfaces of the opposing tubular walls and which interfere with each other to obstruct separation of the head from the body, characterized in that the thread on the head and the axial length of the two tubular walls from which said annular ribs project are such that when the head is rotated in the direction for unscrewing it from the container neck, the thread on the head becomes released or freed from the thread on the neck before the annular ribs mutually interfere to cause withdrawal of the second tubular wall of the body from the hole in the container neck on which the cap is mounted.

Preferably the thread on the head occupies only a portion of the more inner part of the lateral wall of the head.

BRIEF DESCRIPTION OF THE DRAWINGS

To further clarify the understanding of the structure and characteristics of the dispenser cap, a preferred embodiment is described hereinafter by way of non-limiting example with reference to the accompanying drawings, on which.

DETAILED DESCRIPTION OF THE PREFERRED EMBODIMENTS

Figure 1:
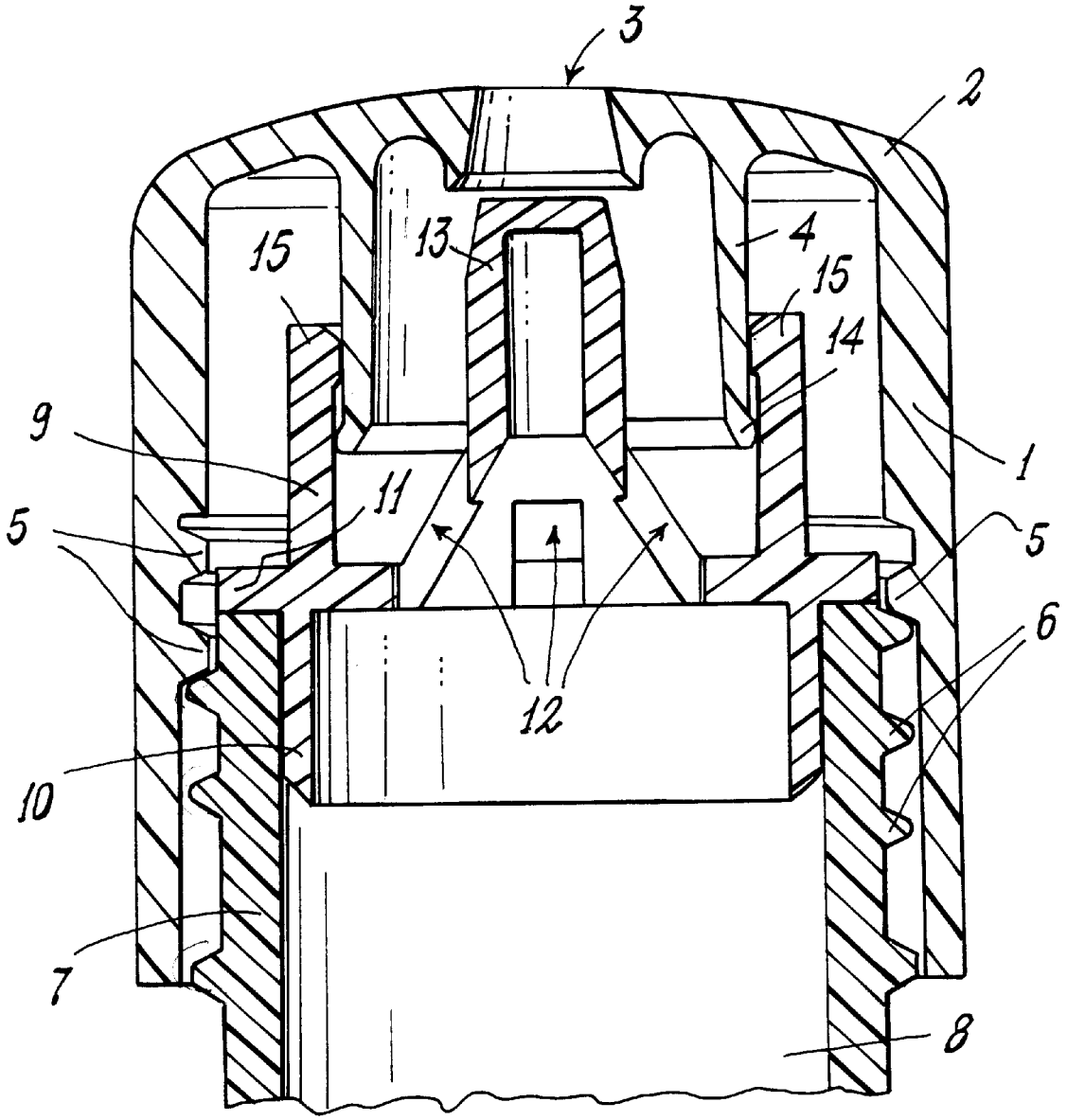
FIG. 1 is an axial cross-sectional view through the cap shown in the open position, mounted on a container mouth.

The dispenser cap, shown in the figures, comprises a head bounded by a outer cylindrical lateral wall 1 and a top wall 2. The center of the top wall 2, a discharge hole 3 is provided. A tubular wall 4 extends from a bottom surface of the top wall into the space enclosed by the lateral wall 1. A helical thread or rib 5 projects from the outer cylindrical lateral wall 1. The helical thread or rib 5 engages a corresponding helical thread or rib 6 projecting from the mouth or neck 7 of a container 8 on which the disease cap is mounted.

In the interior of the head 1, 2 there is housed a profiled body having a first tubular wall 9 surrounding and sealedly slidable on the wall 4, and a second tubular wall 10 which extends in the opposite direction to the wall 9 from an intermediate discoidal element 11 in which apertures 12 are provided connecting together the spaces bounded by the walls 9 and 10.

The outer surface of the tubular wall 10 is shaped to enable it to be forcibly inserted into and retained by friction in the hole in the neck 7 of the container 8, the discoidal element 11 resting on the free edge of the neck 7, but without projecting from it.

The body also comprises an elongate appendix 13 which extends into the interior of the tubular wall 9 and has its free end superposable on and insertable into the hole 3 (FIG. 2) of the head, to seal it.

Finally, it can be seen that from the free edges of the tubular walls 4, 9 there project annular ribs 14 and 15 respectively, which are sealedly slidable on the opposing surfaces of the tubular walls and mutually react (FIG. 1) to hinder or prevent separation of the head 1, 2 from the body 9, 10, 11, 13.

These ribs enable the head and body to be easily snap-assembled, and which, after having been separately produced, and assembled by simply axially screwing one onto the other to form a dispenser cap, are sold as complete caps to the user firm.

To mount the above-described cap on a container the head 1, 2 is screwed directly onto the helical thread (or groove) provided on the outer surface of the container neck, with the helical ribs 5 of the head engaging the ribs 6 of the container neck, with the result that the tubular wall 10 is forced into the hole in the container neck 7 (this wall remaining secured by friction).

Figure 2:
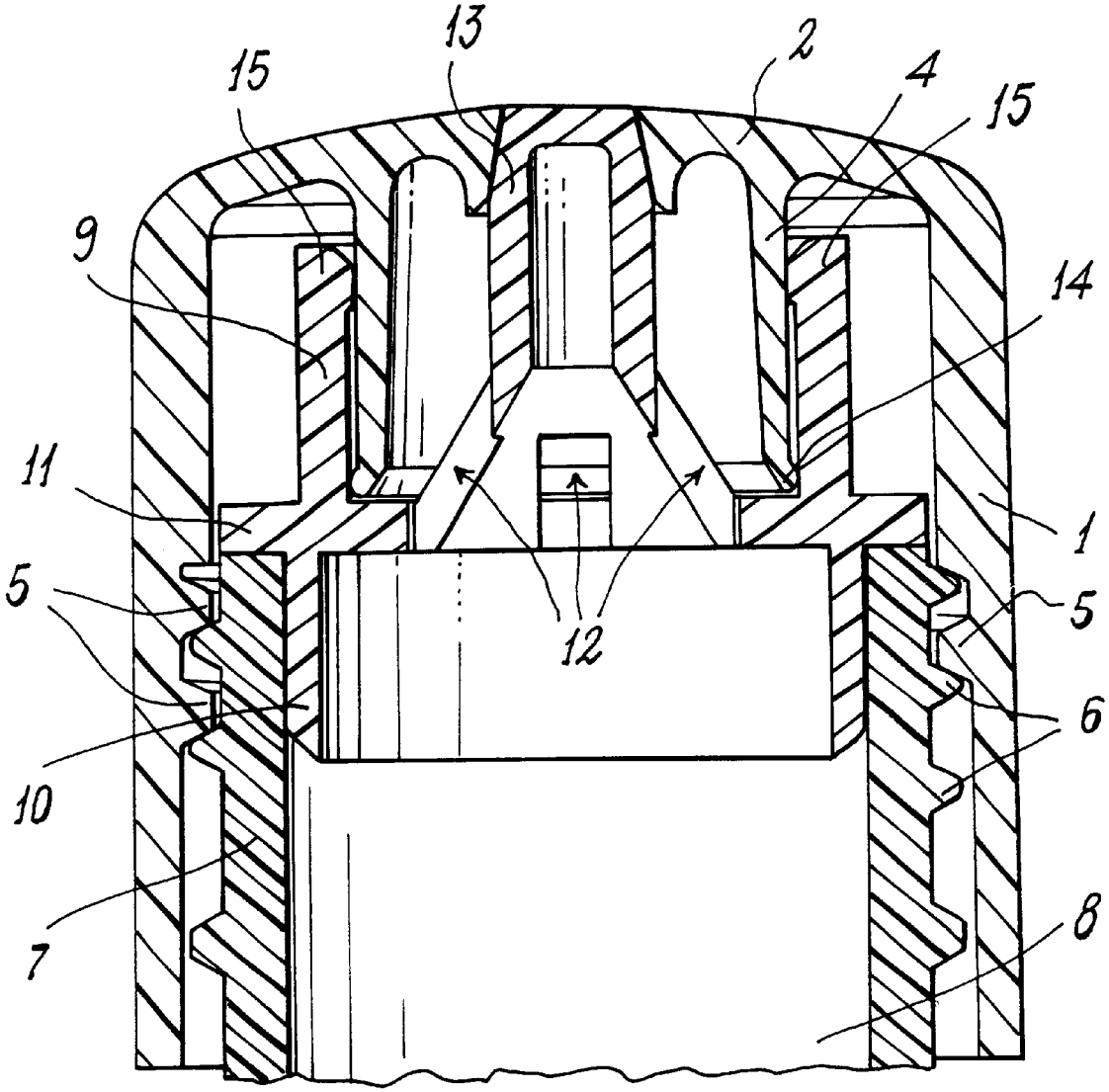
FIG. 2 is an axial cross-sectional view similar to FIG. 1, but showing the cap closed.

When the head has been completely screwed down on the container mouth, the free end of the appendix 13 presses against the discharge hole 3, the container hence being sealed by the dispenser cap (FIG. 2).

When the head is unscrewed on the container neck, the body 9, 10, 11, 13 remains retained and immobile on the mouth, whereas the head is raised and withdrawn from it (FIG. 1), so that the hole 3 is freed from the end of the appendix 13. If the container is inverted with the cap open so that the cap faces downwards, the fluid substance contained in the container can be dispensed to the outside by passing through the space bounded by the wall 10, the apertures 12, the space bounded by the walls 9 and 4, and then the hole 3.

The described dispenser cap is of very simple and low-cost structure, and possesses the characteristic that the only point of possible engagement between its two constituent parts is determined by the mutual interference of the ribs 14, 15.

A further characteristic is that the body 9, 10, 11, 13 does not project laterally from the container neck 7, and that the head superposed on it is screwed directly onto the outer surface of the neck 7. This enables the dispenser cap to be directly fitted onto a traditional container neck, with the further advantage that the hole in the neck can be of relatively large dimensions, enabling the fluid substance to be fed into the container (before fitting the cap onto it) at a high rate, using the same automatic filling machines used to fill containers having the same neck but which may be closed by traditional caps different from that described.

Finally it can be seen that the outer diameter of the tubular wall 9 can be equal to that of the wall 10 or even equal to that of the container neck, in which latter case the discoidal element 11 would not exist and the body would be restrained on the neck 7 by the base of the wall 9 (again formed in one piece with the wall 10).

However, the most important characteristic of the dispenser cap of the present invention is another, for the understanding of which some preliminary explanation will be given.

If the thread 5 provided on the interior of the head and the axial length of the tubular walls were to be such that the annular rib 14 came into contact with the rib 15 while the thread provided on the head was still operationally engaged with the thread 6 provided on the outside of the container neck 7, the head could easily be rotated (with little force) in the sense of unscrewing it off the neck 7 while the rib 14 exerted a strong pull in the axial direction on the rib 15, so tending to pull the body out of the hole in the neck, with consequent danger of accidentally removing the cap from the container neck.

The essential characteristic of the cap of the present invention is hence the fact that when the head is unscrewed on the container neck to move the cap from its closed position (FIG. 2) to its open position (FIG. 1), the thread 5 on the head becomes released from the thread 6 on the neck 7 before the two annular ribs 14, 15 interfere with each other (by which the two ribs would come into contact), so making it impossible for the wall 10 of the body to withdraw from the hole in the neck 7 on which the cap is mounted.

As can be clearly seen from FIG. 1, when the head is rotated into the open position (with the discharge hole 3 completely open and free), the thread 5 on the head becomes released or freely rotatable idly above the free end of the thread provided on the outside of the neck. If the head is further rotated in its unscrewing direction, the two threads 5 and 6 are no longer mutually engaged, and the annular rib 14 is unable to exert any axial thrust on the rib 15 by utilizing the force which would otherwise have derived from the rotation of the head, so that the body cannot be accidentally pulled out of the hole in the neck 7.

If the head were to be pulled axially after its unscrewing (FIG. 1), the body could be removed from the hole in the neck only with extreme difficulty, as it would be necessary to overcome the considerable resistance (friction) to the relative movement between the tubular wall 10 and the surface of the hole in the neck.

What is claimed is:

1. A dispenser cap for dispensing fluid from fluid substance containers, said dispenser cap comprising:

a head including an outer cylindrical lateral wall connected to a top wall;

a discharge hole located in an approximate center of said top wall of said head;

an inner cylindrical lateral wall spaced inwardly from said outer cylindrical lateral wall of said head and extending downwardly from an inner surface of said top wall of said head;

a profiled body housed in an interior of said head and having first and second tubular walls which extend in opposite directions from an intermediate discoidal element, said first tubular wall being located outwardly adjacent to and movable relative to said inner cylindrical lateral wall of said head;

an elongate appendix forming part of said profiled body, being located inside of said first tubular wall, and having a free end which is movable into said discharge hole of said head to seal said discharge hole;

at least one aperture provided in said profiled body to directly connect together spaces bounded by said first and second tubular walls projecting from said intermediate discoidal element of said profiled body;

an outer diameter of said second tubular wall being substantially complementary to an inner diameter of an opening in a neck of a container on which said dispenser cap is to be mounted, said second tubular wall being inserted and retained in the neck of the container;

said intermediate discoidal element of said profiled body having an outwardly-extending shoulder with a diameter greater than said inner diameter of said opening in the neck of the container;

said head is superposable on a free end of the neck of the container and has at least one helical thread on said inner surface of said outer cylindrical lateral wall, said at least one helical thread being engageable with a corresponding helical thread provided on an outer surface of the neck of the container to enable said head to be screwed or unscrewed on the neck of the container between a position in which said discharge hole in said top wall of said head is sealed by said free end of said elongate appendix of said body and a position in which said discharge hole in said top wall of said head is open and distant from said elongate appendix;

annular ribs project from opposing surfaces of said inner cylindrical lateral wall extending downwardly from said inner surface of said top wall of said head and said first tubular wall of said profiled body, said annular ribs being located in proximity to free ends of said inner cylindrical lateral wall of said head and said first tubular wall of said profiled body, said annular ribs sealing against said opposing surfaces of said inner cylindrical lateral wall of said head and of said first tubular wall of said profiled body, said annular ribs interfering with each other to prevent separation of said head from said profiled body, wherein said at least one helical thread on said inner face of said outer cylindrical lateral wall of said head and an axial length of said first tubular wall of said profiled body and said inner cylindrical lateral wall of said head from which said annular ribs project are such that when said head is rotated in a direction for unscrewing said head from the neck of the container, said at least one helical thread on said inner surface of said outer cylindrical lateral wall of said head becomes released from the helical thread on the outer surface of the neck of the container before said annular ribs mutually interfere with each other to thereby cause withdrawal of said second tubular wall of said profiled body from said opening in the neck of the container on which said dispenser cap is mounted.

2. The dispenser cap as claimed in claim 1, wherein said thread on said head occupies only a portion of a more inner part of said outer cylindrical lateral wall of said head.

* * * * *